US006198698B1

(12) United States Patent
Graves

(10) Patent No.: US 6,198,698 B1
(45) Date of Patent: Mar. 6, 2001

(54) ILLUMINATING, VISUAL, TIME INDICATING DEVICE

(76) Inventor: Anthony Graves, 1125 Hubbard St., Eden, NC (US) 27288

( * ) Notice: Subject to any disclaimer, the term of this patent is extended or adjusted under 35 U.S.C. 154(b) by 0 days.

(21) Appl. No.: 09/350,420

(22) Filed: Jul. 8, 1999

(51) Int. Cl.[7] ..... G04C 19/00; G04C 17/00; G04B 19/00

(52) U.S. Cl. ..... 368/82; 368/223; 368/240

(58) Field of Search ..... 368/82–84, 223, 368/239–242

(56) References Cited

U.S. PATENT DOCUMENTS

| | | | | |
|---|---|---|---|---|
| 3,427,800 | | 2/1969 | Blum | 58/126 |
| 3,798,892 | | 3/1974 | Lukens | 58/50 |
| 4,028,876 | | 6/1977 | Delatorre | 58/1 R |
| 4,312,055 | * | 1/1982 | Noble | 368/29 |
| 4,702,615 | | 10/1987 | Havel | 368/82 |
| 4,759,002 | | 7/1988 | Cash | 368/15 |
| 4,885,731 | | 12/1989 | Massaro | 368/228 |
| 5,199,009 | * | 3/1993 | Svast | 368/240 |
| 5,228,013 | | 7/1993 | Bik | 368/223 |
| 5,422,864 | | 6/1995 | Lorello | 368/223 |
| 5,526,327 | * | 6/1996 | Corouga, Sr. | 368/82 |
| 5,638,341 | | 6/1997 | Amano | 368/223 |
| 5,694,376 | * | 12/1997 | Sullivan | 368/82 |

* cited by examiner

*Primary Examiner*—Vit Miska
(74) *Attorney, Agent, or Firm*—John D. Gugliotta

(57) ABSTRACT

An illuminating, visual, time indicating device, incorporating a new and innovative time telling indication means that is both functional and stylistic. The watch utilizes LCD or other illuminating or indicating technology to indicate the hour by illuminating the number on the watch face, while indicating the minute in a pie chart like manner, filling the entire watch face in a clockwise fashion as the hour passes. The appearance of the watch conveys the time to the user at a glance while providing an outward appearance of style.

8 Claims, 5 Drawing Sheets

ILLUMINATING, VISUAL, TIME INDICATING DEVICE

RELATED APPLICATIONS AND DISCLOSURES

The present invention was first disclosed in the Disclosure Document filed on Sep. 25, 1998. There have been no previously filed, nor any co-pending applications, anywhere in the world.

BACKGROUND OF THE INVENTION

1. Field of the Invention

The present invention relates generally to watches and clocks, and, more particularly, to an illuminating, visual, time indicating device.

2. Description of the Related Art

Modern fashion trends dictate an ever evolving and changing of popularity wherein the clothing and accessories that are considered cutting edge today are considered passe tomorrow. In keeping with these trends, society's strong desire to be different and its willingness to be judged by the clothes that one wears, the industry is in a constant search for new and innovative styles that will help to define the next fashion trend.

Not limited strictly to clothing, this need for innovation extends to all areas of fashion, including that of accessories. Accordingly, there is a constant need for new and innovative ideas that not only create new clothing styles, but also that innovate the fashion accessory market In the related art, several devices are disclosed that describe a dual-hemisphere timepiece with different coloring or shading. These include U.S. Pat. No. 5,422,864, issued in the name of Lorello, U.S. Pat. No. 4,759,002, issued in the name of Cash, U.S. Pat. No. 3,798,892, issued in the name of Lukens and U.S. Pat. No. 3,427,800, issued in the name of Blum.

Several patents disclose an apparatus for visually indicating elapsed time through a color change. These include U.S. Pat. No. 5,228,013, issued in the name of Bik, U.S. Pat. No. 4,702,615, issued in the name of Havel and U.S. Pat. No. 4,028,876, issued in the name of Delatorre.

U.S. Pat. No. 5,638,341, issued in the name of Amano describes character panel of a watch separated according to color in three wedge-shaped portions.

U.S. Pat. No. 4,885,731, issued in the name of Massaro, discloses a child's easy-to-read timepiece.

A search of the prior art did not disclose any patents that anticipate directly many features of the instant invention. Consequently, a need has been felt for providing a new apparatus and method for indicating time utilizing visual and graphical as well as number recognition techniques.

SUMMARY OF THE INVENTION

It is therefore an object of the present invention to provide an improved, an illuminating, visual, time indicating device that provides a functional, stylish, novel method of displaying the correct time in either a watch or clock.

Briefly described according to one embodiment of the present invention, an illuminating, visual, time indicating device is disclosed, incorporating a new and innovative wristwatch design that is both functional and stylistic. The electronic timepiece of the present invention incorporates liquid crystal display (LCD) or other illuminating or indicating technology to produce a watch that indicates time in an unconventional manner that is both decorative and stylistic. Incorporating a hybrid form of the hour/minute hand design commonly found on conventional timepieces, the LCD watch face of the present invention indicates the hour by illuminating the number on the watch face while indicating the minute in a pie chart like manner, filling the entire watch face in a clockwise fashion as the hour passes. The appearance of the watch conveys the time to the user at a glance while providing an outward appearance of style.

Capable of incorporation into a wall clock design as well, use of the present invention affords the user the ability to quickly and easily determine the time while also creating a conversation piece that will be sure to draw the attention and appreciation of all those that view it.

It is another object of the present invention to provide a new time indication method using graphic display functions as well as colors.

It is another object of the present invention to provide a quick and easy way to use time indication device.

| DESCRIPTIVE KEY | |
|---|---|
| 10 | illuminating, visual, time indicating device |
| 15 | watch body |
| 20 | strap |
| 25 | fastening means |
| 30 | watch face |
| 35 | hour indicia |
| 40 | current hour number |
| 45 | shaded area |
| 50 | leading edge |
| 55 | first time setting means |
| 60 | second time setting means |
| 65 | clock body |
| 70 | movement direction arrow |
| 75 | battery |
| 80 | main controller |
| 85 | crystal oscillator |
| 90 | frequency dividing network |
| 95 | first output |
| 100 | lamp driver module |
| 105 | common return lead |
| 110 | second output |
| 115 | display driver module |
| 120 | pie-shaped indicating segment |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1, 3*a* through 3*c*, 4 and 5.

1. Detailed Description of the Figures

Figure 1:
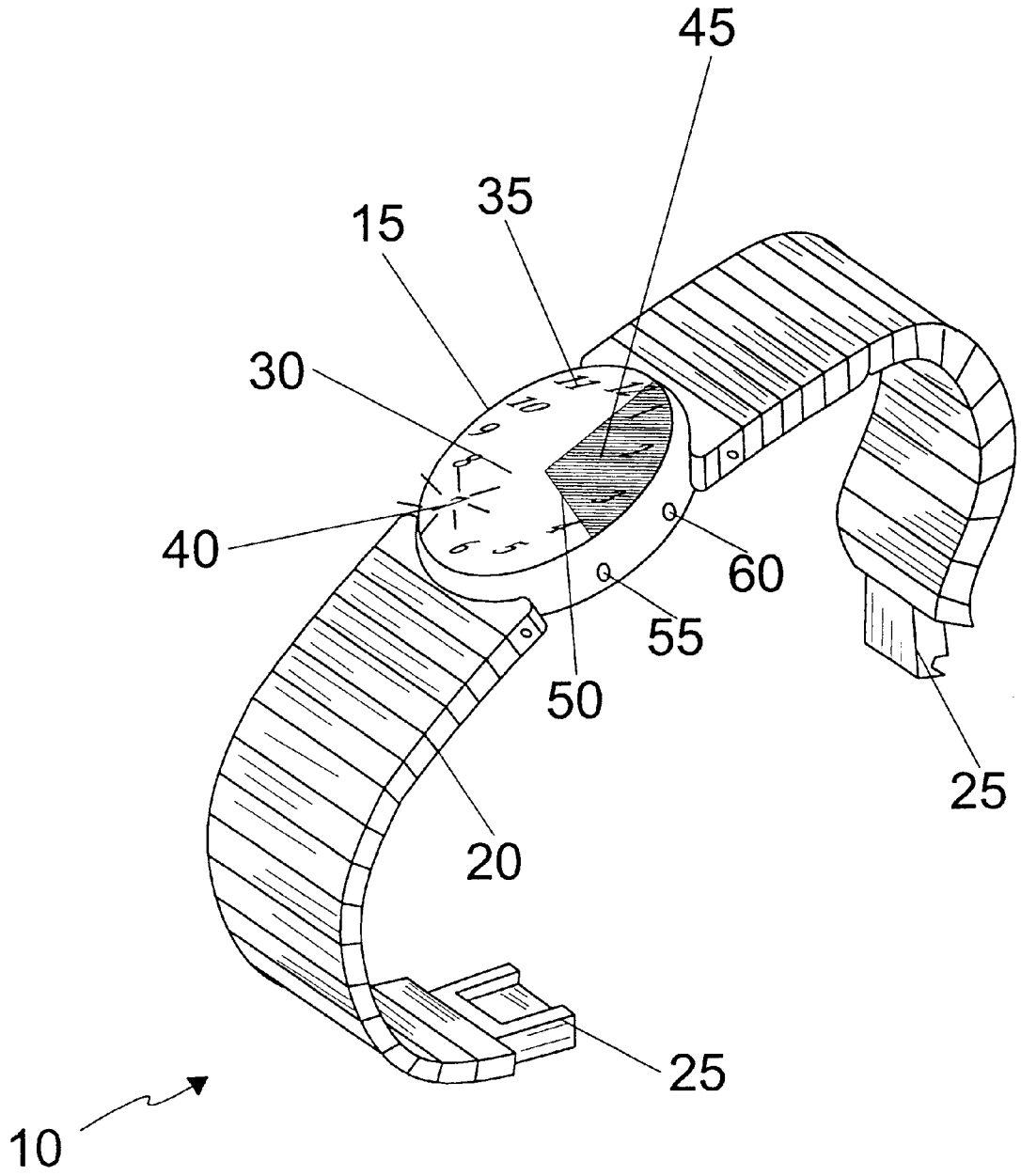
FIG. 1 is a perspective view of the preferred embodiment of an illuminating, visual, time indicating device 10.

Referring now to FIG. 1, an illuminating, visual, time indicating device 10 is disclosed, according to the preferred embodiment of the present invention. The preferred embodiment of the present invention discloses an electronic timepiece. A watch body 15, complete with a strap 20 and a fastening means 25, such as a clasp or buckle, as would be found on a conventional watch is indicated. A watch face 30 complete with hour indicia 35, as arranged in a circular pattern as would be found on a conventional watch, is supplied on the upper portion of the watch body 15. A current hour number 40, corresponding to the actual hour of the actual time, is supplied in an illuminated manner as shown. The current hour number 40, in the case of this FIG. 1s indicated as the 7:00 hour is illuminated for illustrative purposes, but could also equally be any of the other eleven hour indicia 35. It is envisioned that the illumination method of the current hour number 40 would be provided by a small light emitting diode (LED), however, it can be seen by those familiar in the art, that other methods such as incandescent lamps, liquid crystal displays, neon lamps, and the like could also be utilized with equal success and as such should not be considered a limiting factor. In such a manner thus is indicated the current hour. If the numeral 7 is illuminated, it is the 7:00 hour. If the numeral 12 is illuminated, it is the 12:00 hour. This pattern continues in a circular pattern throughout all of the hour indicia 35 in a circular pattern and then repeats. A shaded area 45 is used to indicate the current minute of the current hour. It is envisioned that the shaded area 45 would be provided by a liquid crystal display (LCD), though other means such as plasma displays, analog mechanical displays, could also be utilized and may well be more appropriate on larger size watches or even stationary clocks as will be shown below. It is envisioned that the shaded area 45 would be capable of displaying various colors that would contrast sufficiently with the color of the watch face 30 so as to permit quick and easy telling of time. The circuitry which drives the shaded area 45 and the corresponding leading edge 50 will be described in greater detail herein below. A leading edge 50 as defined by the first segment of the shaded area 45 one would contact when traveling in a counterclockwise manner on the watch face 30, indicates the minutes of the current time. In FIG. 1, the time of approximately 18 minutes past the hour is indicated. This leading edge 50 will advance in a clockwise rotational manner in a graphical, pie chart like manner, filling the entire watch face in a clockwise fashion as the hour passes. Thus, the present invention Incorporates a hybrid form of the hour/minute hand design commonly found on conventional timepieces. Finally, also shown in FIG. 1 is a first time setting means 55 and a second time setting means 60, which are envisioned to be switches. Both the first time setting means 55 and the second time setting means 60 would be utilized in the initial setting of the current time on the illuminating, visual, time indicating device 10. It is envisioned that the first time setting means 55 would either select the hour, the minute or reset in a rotational pattern and the second time setting means 60 would be used to advance either the hour or the minute in a manner found similar to that used when setting a conventional watch.

Figure 2:
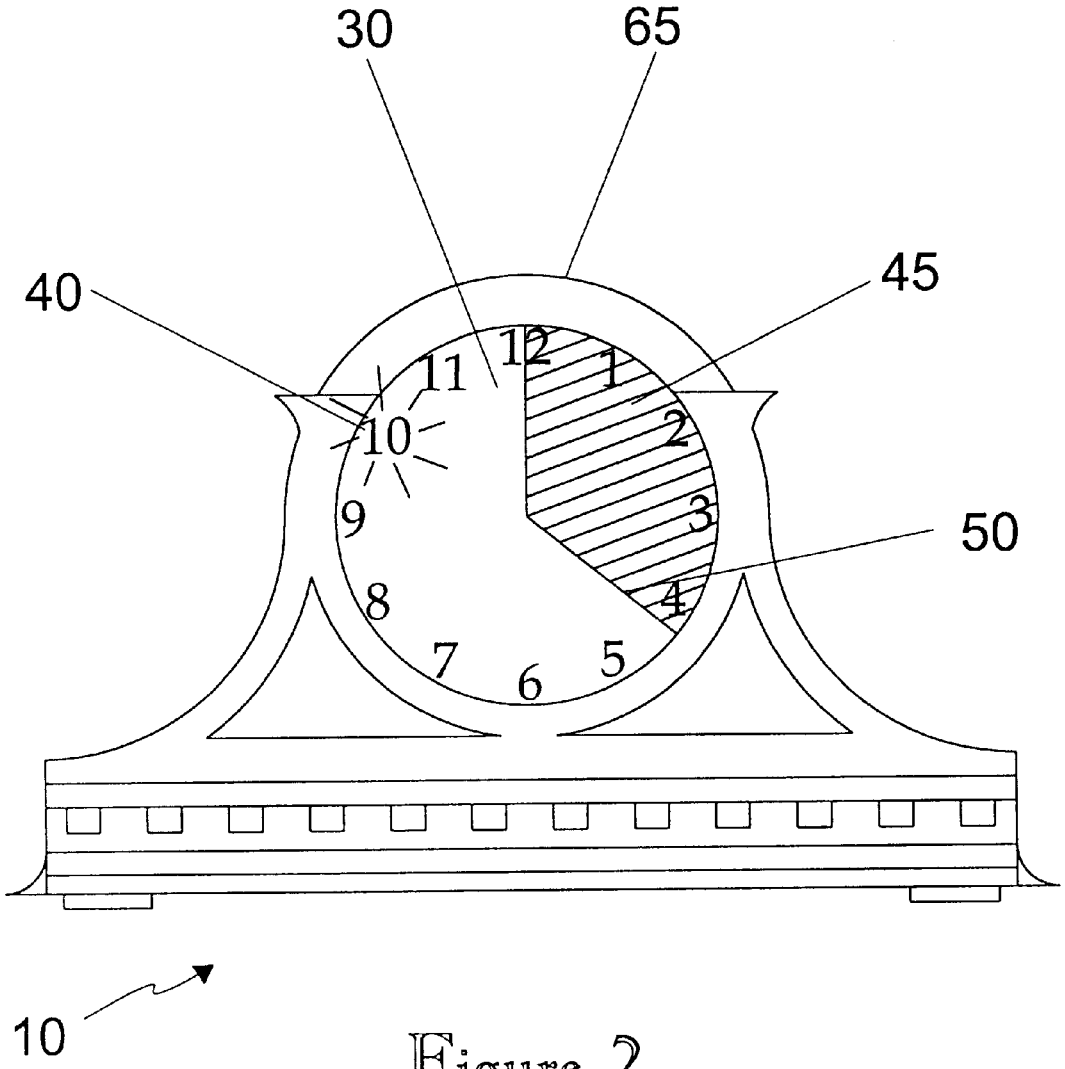
FIG. 2 is a perspective view of an alternate embodiment of the present invention, namely a clock.

Referring next to FIG. 2, an alternate embodiment of the present invention, a clock incorporating the technology and time telling method of the present invention is shown. In this embodiment the watch face 30 is shown mounted to a clock body 65. For purposes of illustration, the clock body 65 is shown as a mantle clock, but any type of stationary clock, such as a table clock, a wall clock, a grandfather clock, or the like could be equipped with the time telling characteristics of the illuminating, visual, time indicating device 10 as aforementioned described in FIG. 1. The current hour number 40 in this FIG. is shown as the numeral "10". The shaded area 45 along with its corresponding leading edge 50 yields the determination of minutes after the hour as approximately "22". Thus, the corresponding time indicated is 10:22.

Figure 3A:
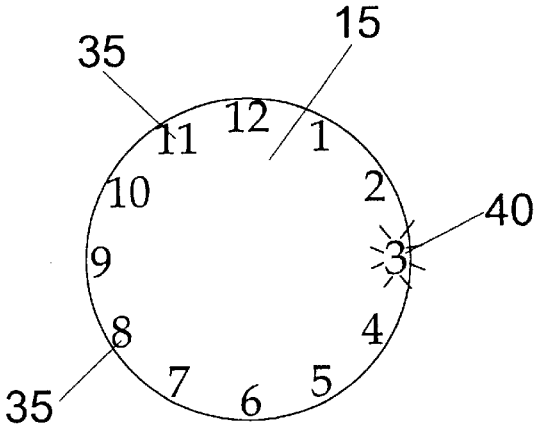
FIG. 3*a* through 3*c* are a series of front views indicating 3:00, 3:12 and 3:50 respectively.

Referring now to FIG. 3*a*, to indicate 3:00, the hour indicia 35 which is illuminated is the number "three", depicted by the current hour number 40 on the watch body 15, while no portion of the watch body 15 is illuminated in a pie chart fashion, thereby indicating the status of no minutes past the hour.

Figure 3B:
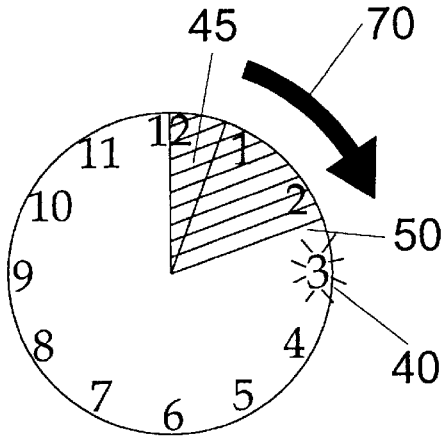

Referring next to FIG. 3*b*, as the time passes, a pie chart shaped shaded area 45 expands clockwise, with the leading edge 50, representing a minute hand at 12:00, staying stationary, and forming the top of the pie chart illuminated section. The pie chart shaded area 45 expands in a rotational pattern as time passes as indicated by a movement direction arrow 70. This expanding edge of the shaded section actually corresponds to a minute hand moving around the watch face as time passes. As previously indicated in FIG. 3*a*, the current hour number 40 is illuminated indicating the three o'clock hour. At 3:12, the shaded section has expanded downward, with the leading edge 50 corresponding to twelve minutes past the hour.

Figure 3C:
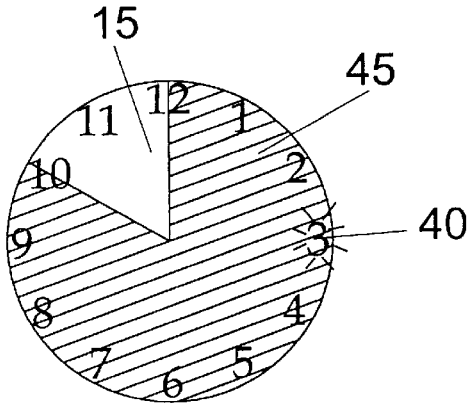

Referring now to FIG. 3*c*, at 3:50, five-sixths of the watch body 15 is covered by the shaded area 45, leaving the upper left quadrant unshaded, informing the user that it is fifty minutes past the hour of three. The three o'clock hour is determined by the illumination of the current hour number 40 namely three.

Figure 4:
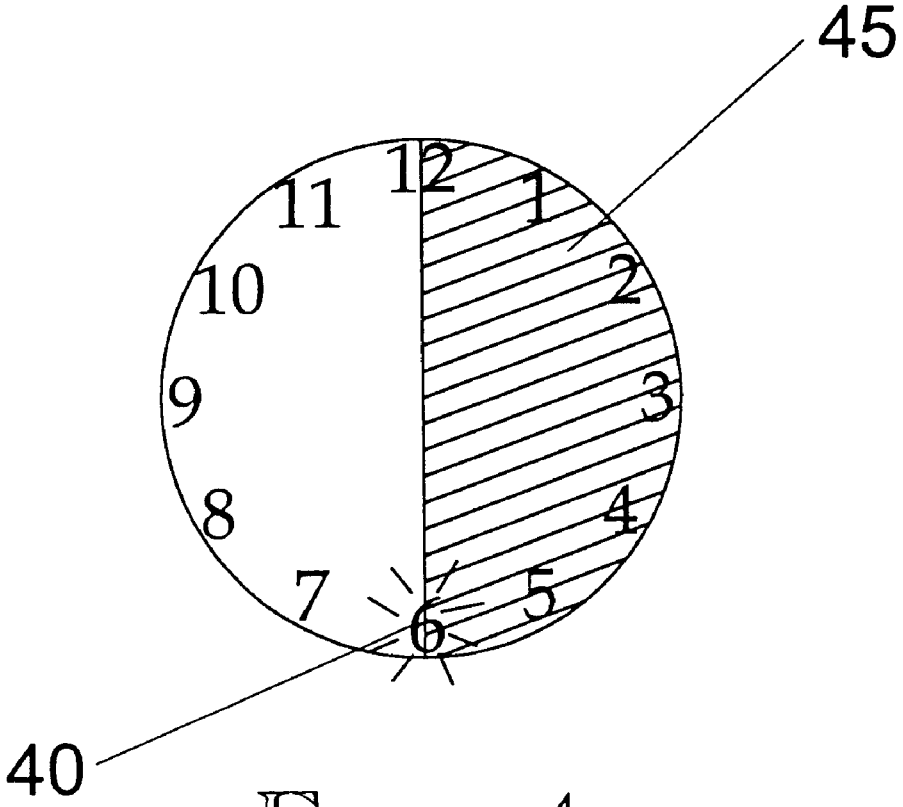
FIG. 4 is a front view indicating 6:30.

Referring next to FIG. 4, a front view of the illuminating, visual, time indicating device 10 illustrates the visual indicia corresponding to 6:30. The current hour number 40 six is illuminated, and the shaded area 45 has expanded to include the entire right side of the watch face.

Figure 5:
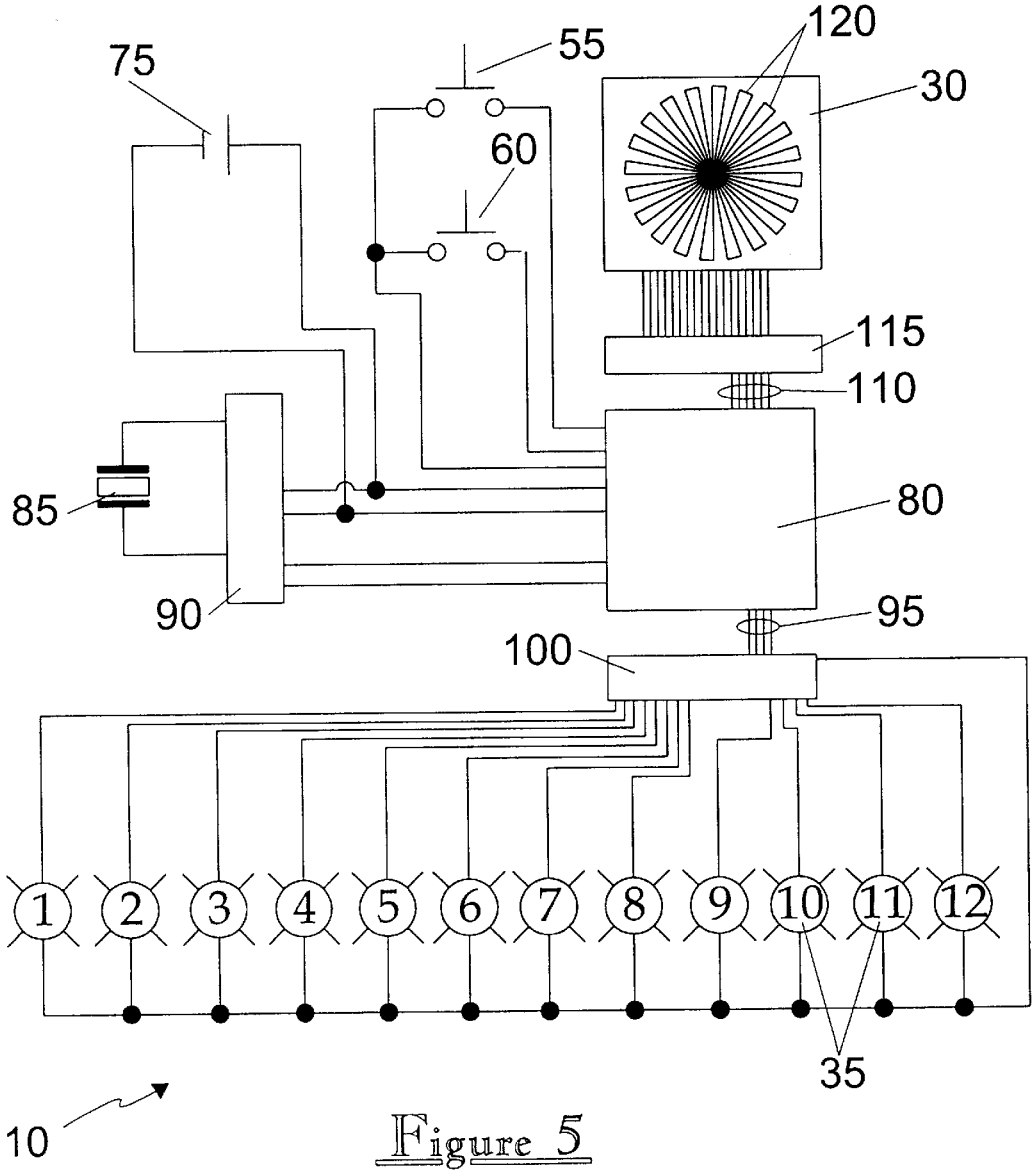
FIG. 5 is an electrical schematic block diagram depicting the circuitry associated with the present invention.

Referring finally to FIG. 5, an electrical schematic block diagram depicting the circuitry associated with the illuminating, visual, time indicating device 10 is disclosed. Electrical power for the illuminating, visual, time indicating device 10 is provided by a battery 75. Power is routed to a main controller 80 which provides the main controlling function of the illuminating, visual, time indicating device 10. The operation and configuration of the main controller 80 is well known in the art, and is not expanded here for purposes of clarity. Power is also routed to a combination of a crystal oscillator 85 and a frequency dividing network 90 which provides the time keeping function. The crystal oscillator 85 oscillates at a high frequency rate in a continuous manner at a very steady state. The frequency dividing network 90 serves to divide or count the frequency pulses at a rate to allow the main controller 80 to provide for the advancement of minutes and hours. The operation of the crystal oscillator 85 and the frequency dividing network 90 is well known in the art, and is not expanded here for purposes of clarity. Additionally, the first time setting means 55 and the second time setting means 60 allow for the setting of the current time in the manner aforementioned described in FIG. 1. A first output 95 from the main controller 80 drives a lamp driver module 100. It is envisioned that the lamp driver module 100 would be a binary coded decimal (BCD) to decimal driver. The output drives each of the hour indicia 35 through a common return lead 105. The second output 110 drives a display driver module 115, such as a LCD segment driver. Each output pulse individually energizes a pie-shaped indicating segment 120 of the watch face 30 in a clockwise rotational pattern. When the last pie-shaped indicating segment 120 is energized, they all extinguish after an appropriate period of time and the cycle resumes anew. While the above description of the electrical circuit is primarily direct at the preferred embodiment configuration of the watch as shown in FIG. 1, minor changes well known in the art allow for similar circuitry to control the illuminating, visual, time indicating device 10 as provided with the alternate embodiment as depicted in FIG. 2. These changes include electrical power from house current and a power supply in lieu of batteries, a frequency-based time keeping regulator in lieu of a crystal-based controller, and mechanically based or other electrically based methods of illuminating devices and/or surfaces as earlier described.

It is envisioned that other styles and configurations of the present invention can be easily incorporated into the teachings of the present invention, and only one particular configuration will be shown and described for purposes of clarity and disclosure and not by way of limitation of scope.

2. Operation of the Preferred Embodiment

The present invention is designed with ease of operation features in mind that allow it to be set and utilized by a common individual with little or no training, and operated in a transparent and intuitive manner with respect to conventional time keeping pieces.

To use the present invention, the user would set the correct time on the illuminating, visual, time indicating device 10 using the appropriate first time setting means 55 or the second time setting means 60 to energize the appropriate hour indicia 35 and the appropriate pie-shaped indicating segment 120 corresponding to the leading edge 50 of the shaded area 45. At this point the illuminating, visual, time indicating device 10 is ready to be utilized to indicate the correct time to any individual wearing or viewing the illuminating, visual, time indicating device 10.

To determine the correct time, the user finds the current hour number 40 located on the circumferential edge of the watch face 30. This number tells the user the hour. To determine the minute, the user looks to see how much of the watch face 30 is covered by the shaded area 45 and what position on the watch face 30 the leading edge 50 lies. The leading edge 50 actually acts as a minute hand, and can be used to decipher the exact minute past the hour. The shaded section also provides the user a quick graphical interpretation of how many minutes have been used in the current hour.

The foregoing description is included to illustrate the operation of the preferred embodiment and is not meant to limit the scope of the invention. The scope of the invention is to be limited only by the following claims.

What is claimed is:

1. An illuminating, visual, time indicating device and method for telling time, comprising:

an electric time piece, complete with a face;

at least one time setting means, said time setting means used to set the time on said time piece;

hour indicia, said hour indicia located along the outer circumferential edge of said face, with each hour indicia designed to light up to signify a certain hour; and a shaded section, said shaded section indicating the minutes past the hour, in a pie chart like manner, filling the entire face in a clockwise fashion as the hour passes.

2. The illuminating, visual, time indicating device and method for telling time described in claim 1, wherein said hour indicia are numbers positioned on said face like a traditional time piece.

3. The illuminating, visual, time indicating device and method for telling time described in claim 1, wherein as the time passes, said pie chart shaped shaded section expands clockwise, with a vertical line, representing a second hand at 12:00, staying stationary, and forming the top of said pie chart illuminated section; said pie chart configured shaded section expanding downward as time passes, with this expanding end of the shaded section actually corresponds to an imaginary second hand moving around said face as time passes.

4. The illuminating, visual, time indicating device and method for telling time described in claim 1, wherein said shaded section is illuminated.

5. The illuminating, visual, time indicating device and method for telling time described in claim 1, wherein said shaded section is colored.

6. The illuminating, visual, time indicating device and method for telling time described in claim 1, wherein said hour indicia are colored when illuminated.

7. The illuminating, visual, time indicating device and method for telling time described in claim 1, wherein:

to tell the hour, the user finds said lighted hour indicia located on the circumferential edge of said face, thus telling the user the hour; and to discover the number of minutes past the hour, the user looks to see how much of said face is covered by said pie shaped, shaded section, with the leading edge of the shaded section actually acting as a minute hand, and capable of being used to decipher the exact minute past the hour.

8. The illuminating, visual, time indicating device and method for telling time described in claim 1, wherein said time piece is a watch.

* * * * *